United States Patent [19]

Burt

[11] 4,220,108

[45] Sep. 2, 1980

[54] MINESWEEPING METHOD AND APPARATUS

[76] Inventor: Wayne E. Burt, 1603 Avenue R., Huntsville, Tex. 77340

[21] Appl. No.: 763,419

[22] Filed: Sep. 27, 1968

[51] Int. Cl.[3] ..... B63G 9/00

[52] U.S. Cl. ..... 114/244; 102/18 MS

[58] Field of Search ..... 114/235; 144/221

[56] References Cited

U.S. PATENT DOCUMENTS

| | | | |
|---|---|---|---|
| 2,937,611 | 5/1960 | Schaelchlin et al. | 114/221 R |
| 3,012,534 | 12/1961 | Thomas | 114/244 X |
| 3,327,968 | 6/1967 | Converse | 114/244 X |

*Primary Examiner*—David H. Brown

*Attorney, Agent, or Firm*—Louis A. Miller; Don D. Doty; William T. Skeer

[57] ABSTRACT

A device employing a permanent magnet is used to provide a sweep for magnetically activated marine mines.

10 Claims, 6 Drawing Figures

MINESWEEPING METHOD AND APPARATUS

The invention described herein may be manufactured and used by or for the Government of the United States of America for governmental purposes without the payment of any royalties thereon or therefor.

In modern naval warfare, the loss of shipping and warships to the enemy by marine mines is an ever present threat. A particularly effective type of marine mine is actuated magnetically by the passage of naval or other vessels. A typical sweep for this type of marine mine is to tow a device producing a large magnetic disturbance aft of a small minesweeping craft. The minesweeper passes over the mine undetected and unharmed because of its low magnetic field, and the magnetic device detonates the mines lying within a predetermined effective area safely astern the minesweeper. If a sweep over a large area is desired, additional minesweepers towing similar magnetic sweep devices follow the first minesweeper at a safe distance. Each of said additional following minesweepers follow at the outer edge of the area swept by the preceding minesweeper, making a V-formation, and only the first minesweeper navigates an unswept course.

Although a present state-of-the-art design minesweeper has a very low magnetic signature, magnetic detection methods as used in mine technology have advanced to the point where even a minesweeper may be detected. These advances in mine construction have made the use of the aforementioned sweep techniques hazardous, as well as expensive to utilize. If the first minesweeper falls victim to a magnetically detonated mine, one of the following minesweepers moves into the lead position. This alteration of the minesweeping flotilla causes an unfavorable modification of the swept area, not to mention considerable distress occasioned by the loss or injury of personnel on the stricken vessel.

It is to this situation that this invention addresses itself. Applicant has devised a device which may be advanced along the course of the minesweeping vessels to provide a swept channel for the first minesweeper. The use of the device makes the minesweeping operation described above much safer to conduct, thereby increasing its effectiveness while decreasing the likelihood of suffering loss of ships or personnel.

Having the foregoing operation in mind, it is an object of this invention to provide a device and method for sweeping magnetically responsive marine mines in advance of the passage of a surface naval vessel.

Another object of this invention is the provision of a minesweeping device which will provide a magnetic sweeping signal in response to a controlling electrical signal.

Yet another object of this invention is the provision of a device which will produce a varying magnetic signal in an underwater environment as a result of being propelled therethrough.

A further object of this invention is the provision of a minesweeping device with a permanent magnetic field associated therewith and a surface configuration that produces a non-uniform trajectory, as it is towed through a body of water.

A still further object of this invention is the provision of a minesweeping device having a fluid current motor which alters a magnetic field producing element in response to the minesweeping device being propelled through the water.

Another object of this invention is the provision of a minesweeping device adapted to be towed through mined waters from an aircraft or remotely controlled surface watercraft.

Other objects and many of the attendant advantages will be readily appreciated as the subject invention becomes better understood by reference to the following detailed description, when considered in conjunction with the accompanying drawings wherein.

Figure 1:
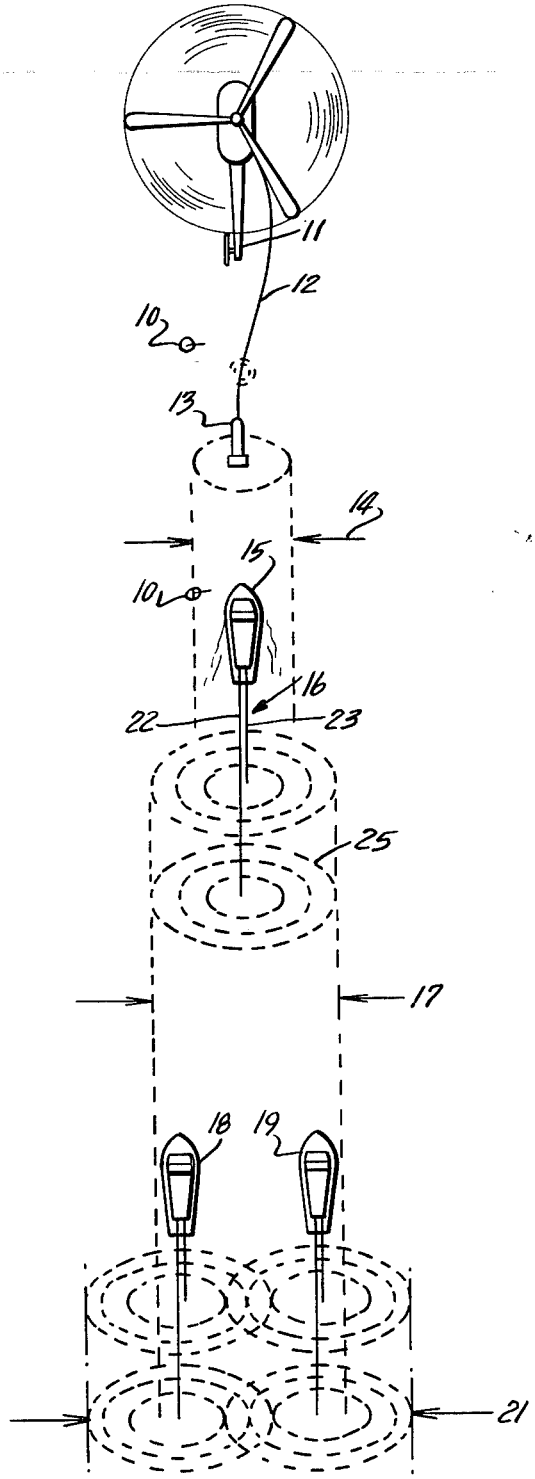
FIG. 1 illustrates the device of the invention in use.

Referring to FIG. 1, there is shown a tow vehicle, such as aircraft 11, towing along a course previously marked by buoys 10, via line 12, a minesweeping device 13 according to the invention. A magnetic field of predetermined characteristics, as will be herein described, is generated by a permanent magnet and surrounds device 13. This field sweeps a pathway, indicated by arrows 14, as a result of the device 13 being towed by aircraft 11. Although the tow vehicle is shown in this particular instance as being a rotary wing aircraft, it should be understood that other aircraft types may be employed for this purpose. Likewise, minesweeping device 13 may be propelled by a small, remote-controlled surface craft or any other suitable tractor device in place of the aircraft shown. Similarly, a self propelled device 13 could be employed, if desired.

A minesweeper 15 towing conventional magnetic sweep gear 16 follows at a safe distance astern device 13 in the channel swept thereby. The magnetic field produced by gear 16 is larger than that produced by minesweeping device 13 and is effective to actuate and thereby sweep magnetic mines in a larger pathway, as indicated by arrows 17. In a similar fashion, minesweepers 18 and 19 follow minesweeper 15, clearing a channel indicated by arrows 21. Additional minesweepers or additional passes may be used until a channel of the desired width has been cleared.

The sweep gear 16 may be of any conventional type used for the purpose. For example, two parallel conductors 22 and 23 of differing lengths having their ends exposed to the sea water may be used. An electrical signal of a predetermined frequency and waveform is fed to conductors 22 and 23 and an electrical circuit therebetween is completed by the conduction of the sea water. The currents flowing in the shorter conductor 23 and the adjacent portion of the longer conductor 22 are equal but of opposite direction, therefore the magnetic fields are of such a nature that they cancel each other. The electrical current flowing in the sea water is of a much lower current density that that flowing in the remaining portion of the longer conductor 22 and, therefore, the field, represented by concentric rings 24 and 25 produced by the remaining portion of the longer conductor 22, is uncancelled. This field activates the magnetic mines at a safe distance astern of minesweeper 15. As noted above, the sweep gear used by minesweepers 15, 18, and 19 may include other devices, including that of the invention, minesweeping device 13, which will now be described.

Figure 2:
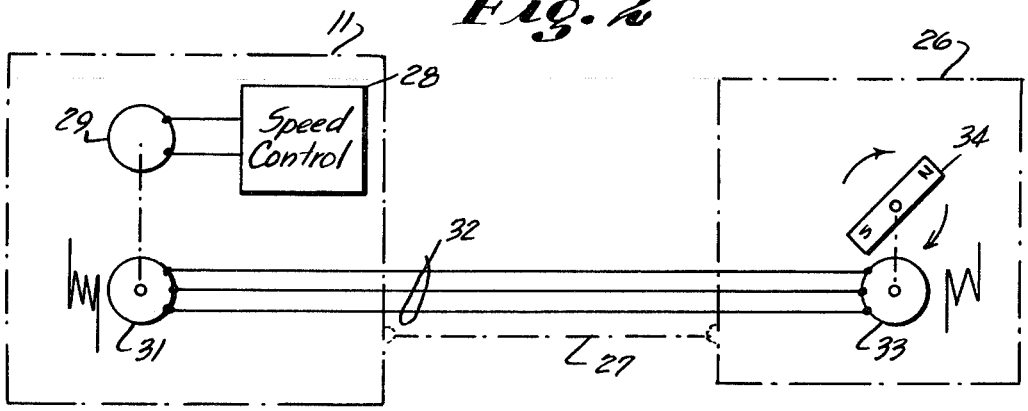
FIG. 2 shows schematically the electrical control system which may be employed with the invention.

FIG. 2 illustrates an electrical control system useful in the practice of this invention. One portion is housed in tow vehicle 11 and the other in a suitable underwater towed carrier vehicle 26, which is joined to tow vehicle 11 by a suitable tow line 27. The particular shape and construction of the carrier vehicle 26 is not shown, since any current state-of-the-art towed underwater vehicle, including bottom following or constant depth type, may be employed with the electrical type control shown.

Within tow vehicle 11, an electrical speed control 28 is housed. Speed control 28 may be any suitable electric motor control device, for example, a recorded magnetic tape or, simply, a manually rotated potentiometer, and is electrically connected so as to alter the rotational speed of a motor 29. A synchronous generator 31 connected to, or made integrally with, motor 29 drives, via cable 32, a synchronous motor 33 in carrier vehicle 26. Cable 32 may be constructed so as to be integral with tow line 27, or may be carried thereby, if desired. Motor 33 is connected to a permanent magnet 34 by suitable coupling means 35.

The rotation of motor 33 and the movement of permanent magnet 34 is seen to be responsive to the speed control 28. The resulting variations in magnetic field produced by permanent magnet 34 may be regulated thereby so as to produce an optimum sweep for a given type of magnetic mine. For example, the magnet may be caused to rotate intermittently so as to produce an intermittent pulsating magnetic field in the water about carrier vehicle 11.

This type of control system, as shown, utilizes suitable carrier vehicles 11, which may differ from the simple minesweeping device 13 by including other equipment than the magnetic sweep gear illustrated. Examples of such other equipment which may share the carrier vehicle 26 with the magnetic sweep gear include sonar apparatus, acoustical sweep gear, electrical tracking equipment, or other desired electrical equipment which may be operated via cable 32 by the use of additional conductors.

Figure 3:
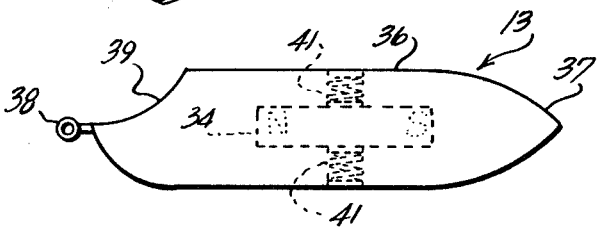
FIG. 3 depicts a species of the device of the invention.

If other electrical gear is not desired to be operated simultaneously with the magnetic sweep, a simplified construction of the minesweeping device 13, as shown in FIG. 3, may be employed in lieu of carrier vehicle 26. The carrier vehicle of FIG. 3 comprises a generally cylindrical body portion 36 housing permanent magnet 34 therewithin in a position determined by suitable mounting means. At the aft end of body portion 36 is a tapered portion 37 and at the foreward end is a towing eye 38. The tapered position 37 is so shaped as to minimize the drag when towed and to permit lateral movement as to be explained. Towing eye 38 permits the attachment of suitable towing line, such as shown at 12 in FIG. 1. Or other conventional towing arrangements may be employed as warranted.

At the foreward end of minesweeping device 13 is a contoured portion 39 which is so shaped as to cause the minesweeping device to vary its trajectory as it is towed. The precise shaping of contoured portion 39 and its relation to the remainder of minesweeping device 13 is a matter of design choice to a proficient naval architect. The parameters of design are similar to those used in the design of a piscatory decoy to simulate the motions of a fish. The device may be directly attached to a towline 12, as shown in FIG. 1, or by means of a short length of line attached to the tow line 12 or a suitable depressor attached thereto. This later arrangement would provide some greater freedom of movement and permit towing minesweeping device 13 at a predetermined depth. Since this towing arrangement is conventionally employed in the minesweeping arts, no further description is included herein.

The movement of minesweeping device 13 through the water causes water to flow over contoured portion 39 and to thereby deflect it from its normal towed trajectory. These deflections are somewhat abrupt and the reorientation of permanent magnet 34 produced thereby causes the magnetic field in the region to be rapidly altered. It should be noted that permanent magnet 34 may be mounted athwart the minesweeping device 13 as well as fore-and-aft, as shown.

If additional variations to the magnetic disturbance caused by the deflections of minesweeping device 13 are desired, permanent magnet 34 may be mounted by suitable resilient means such as springs 41. In such a mounting the abrupt deflections of minesweeping device 13 cause oscillations of the permanent magnet 43 upon its resilient mounting at points of direction change. In place of springs 41, it may be desired to use other elastic means, synthetic rubber compound cones, for example. The important design parameters in the selection of a mounting are the provision of rapid, small-magnitude oscillations and being able to withstand the shock of an aerial drop into the water.

Among the advantages of the species of FIG. 3 are: simplicity of construction, lack of a two vehicle carrier power supply, simple, non-electrical tow line. One of the disadvantages is the difficulty in causing the device to track a precise channel due to the course deflections necessary to obtain the magnetic variations.

Figure 4:
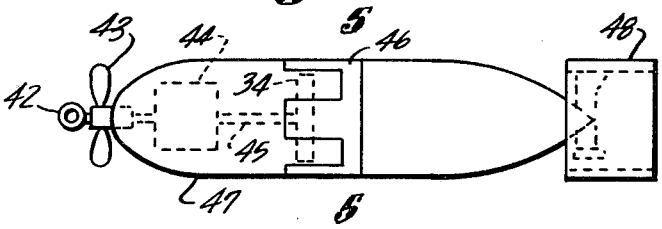
FIG. 4 illustrates another embodiment of the invention.

Referring to FIG. 4, there is shown another embodiment of the invention. This embodiment produces a pulsing magnetic disturbance similar to that of the species of FIG. 3 and, with only a slight increase in mechanical complexity, overcomes the aforementioned tracking difficulty. Just aft of towing eye 42, and coaxial therewith, is located an impeller 43 of a fluid motor. As the minesweeping device is towed through the water, the relative motion therebetween turns the impeller 43. The rotary motion of impeller 43 is transmitted to suitable transmission means 44. The output thereof is transmitted, via coupling means 45, to permanent magnet 34. A castellated magnetically permeable cup 46, which is made integral with housing 47, surrounds the plane of rotation of permanent magnet 34. The device has suitable stabilizing means 48 at the aft end thereof.

Figure 5:
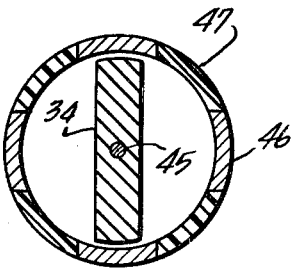
FIG. 5 is a section along line 5—5 of FIG. 4.

The castellated edge of cup 46 extends over the plane of rotation of magnet 34, see FIG. 5, and acts as an intermittent pole piece therefor. As permanent magnet 34 rotates, the poles thereof pass adjacent the castellations so that they alternately provide an internal, flux-directing path and an exposing aperature to the surrounding area through the housing 47. The castellations need not be regularly spaced or of uniform angular extent if asymmetry in the intermittent magnetic disturbance is desired.

Transmission means 44 provides a suitable gear reduction to provide the desired frequency or rate of rotation of permanent magnet 34. If desired, the rotational output may be nonuniform. Additionally, output means 45 may be constructed so as to impart a fore-and-aft motion to permanent magnet 34 as it rotates, thereby withdrawing permanent magnet 34 from the castellations of cup 46. Such a construction may include a cylindrical cam with helical grooves of positive and negative pitch which cooperate with a fixed follower in a manner similar to the action found on a level wind mechanism used on winding and reeling devices. Since the particular construction of the mechanism contributing to the reciprocation of the rotating magnet is not critical, and since a variety of conventional structures to accomplish the rotary-to-reciprocating-and-rotary motion conversion are known, no specific construction for accomplishing this action is shown in interest of clarity and conciseness of the drawings.

Likewise, the attachment of permanent magnet 34 to coupling means 45 may be made with resilient means to provide secondary, small-magnitude oscillations of permanent magnet 34 in a manner similar to that of the device of FIG. 3. Such a construction is shown in FIG. 6, as it might apply to the fluid motor operated embodiment shown in FIG. 4; but it should be apparent that such a magnet mounting technique is equally applicable to the embodiment shown in FIG. 2, if desired.

Figure 6:
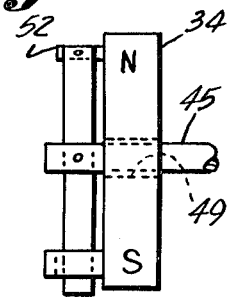
FIG. 6 is an illustration of a magnet mounting technique used in the invention.

As shown in FIG. 6, coupling means 45 extends through aperature 49, which is slightly oversize with respect to coupling means 45, and is slidably secured to a suitable resilient means, such as a non-magnetic leaf spring 51. A non-magnetic post 52 extending from one pole of magnet 34 is secured to one end of leaf spring 51 so as to rigidly join the two. At the opposite end, leaf spring 51 extends through a non-magnetic, apertured post 53. It is seen that coupling means 45 is secured to magnet 34 by the resilient means to rotate magnet 34 in response to its rotation, but that magnet 34 is free to oscillate about the axis of coupling means 45 in response to inertially caused deflections of the resilient means. In place of the sliding spring arrangement shown, helical coil springs could be employed on either side of magnet 34 if less damping of the oscillations is desired.

From the foregoing, it is seen that the instant invention, herein disclosed, meets the aforerecited objects of invention. A compact, expendable device has been provided which is suitable to proceed the lead ship of a small flotilla of minesweepers in the presence of magnetic mines and to sweep a path therefor. More particularly, a sweep device which produces a variation in a local magnetic field by altering the position of a permanent magnet and is small and light enough to permit aerial towing thereof.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A minesweeping device for sweeping magnetic mines positioned along a predetermined course within a body of water to be traversed by the lead ship of a minesweeping flotilla, said minesweeping device comprising:

permanent magnet means having a magnetic field strength of a predetermined value in excess of the field strength of said lead ship and capable of being continuously moved through said body of water along said predetermined course and simultaneously moved arcuately transverse thereto for producing a predetermined magnetic field ambient to said magnetic mines;

housing means for enclosing said magnet means;

means connected to said housing means and effectively connected to the aforesaid permanent magnet means for producing arcuate movement thereof substantially transverse to said predetermined course, so as to produce small time variations of said magnetic field; and means connected to said housing means for attaching thereto a suitable tractor means that is independent of said flotilla for moving said minesweeping device along said predetermined course.

2. A minesweeping device according to claim 1 in which said arcuate movement producing means comprises contoured means for deflecting said housing means within a body of water upon moving said minesweeping device therethrough and along said predetermined course.

3. A minesweeping device according to claim 1 in which the effective connection of said arcuate movement producing means and said magnet means includes resilient means for causing small oscillatory movements of said magnet means to accompany said arcuate movement thereof.

4. A minesweeping device according to claim 3 in which said resilient means includes spring means.

5. A minesweeping device according to claim 1 in which said arcuate movement producing means comprises rotary motor means.

6. A minesweeping device according to claim 5 in which said rotary motor is a fluid motor.

7. A minesweeping device according to claim 5 further including castellated pole piece means carried by said housing means and positioned relative to said magnet means such that said transverse, arcuate movement takes place, at least partially, within the area enclosed by the castellations of said castellated pole piece means, for periodically interrupting the magnetic field of said magnet means during the arcuate movement within said enclosed area.

8. A minesweeping device according to claim 5 in which said rotary motor means is an electric motor.

9. A minesweeping device according to claim 8 further comprising means to control the rotational speed of said electrical motor.

10. A method of sweeping underwater magnetic mines along a predetermined course in a body of water to be navigated by a minesweeper surface craft having a small but finite magnetic field associated therewith, said method comprising the steps of:

marking said predetermined course to make it visible;

towing a minesweeping device containing a permanent magnet means having a magnetic field in excess of said small but finite magnetic field along said marked course and within said body of water so as to subject said underwater magnetic mines to the field of said contained permanent magnet means; and moving said contained magnet means arcuately in a direction transverse to said predetermined course to cause variations in the field strength of said contained permanent magnet means at the locations of said underwater magnetic mines to effect detonation thereof.

* * * * *